United States Patent [19]

Inoue

[11] Patent Number: 4,461,268

[45] Date of Patent: Jul. 24, 1984

[54] DIAMOND SAW

[76] Inventor: Jiro Inoue, 6-5-303, Kami Tsuruma 5-chome, Sagamihara-shi, Kanagawa-ken, Japan

[21] Appl. No.: 336,953

[22] Filed: Jan. 4, 1982

[51] Int. Cl.[3] ..... B28D 1/04

[52] U.S. Cl. ..... 125/15; 51/206 R

[58] Field of Search ..... 51/206 R, 206 P, 206 NF, 51/207; 125/15, 18

[56] References Cited

U.S. PATENT DOCUMENTS

| | | | |
|---|---|---|---|
| 927,164 | 7/1909 | Puffer | 125/15 X |
| 2,268,663 | 1/1942 | Kuzmick | 51/206 R |
| 2,811,960 | 11/1957 | Fessel | 125/15 |
| 3,127,887 | 4/1964 | Metzger | 51/206 R |
| 3,162,187 | 12/1964 | Christensen | 125/15 |
| 3,338,230 | 8/1967 | Lindblad | 125/15 |
| 3,353,526 | 11/1967 | Daem | 125/18 |

*Primary Examiner*—Harold D. Whitehead

*Attorney, Agent, or Firm*—Fay & Sharpe

[57] ABSTRACT

A diamond saw for cutting hard materials, in which a steel plate is fixed with a sintered body consisting of diamond abrasive granules and a bonding metal powder, characterized in that a plurality of grooves having openings are provided at the edges of both the front and back side faces of said sintered body.

13 Claims, 10 Drawing Figures

DIAMOND SAW

This invention relates to an improvement in a diamond saw, and more particularly in a sintered body including diamond abrasive particles embedded in a matrix.

Circular saw and plate-form saw are known as tools for cutting hard materials, and the circular saw has two types of continuous type (rim type) and segment type, while the plate-form saw is grouped generally into gang saw and band saw.

The following are the merits and demerits in the use of the various types of said saws:

(1) The continuous type saw is constructed in such a way that an abrasive granule layer is continuously, firmly fixed at the outer circumference of a steel disc, so that a stripe-pattern based on saw feeding does not appear on the cutting surface of the material to be cut, the finishing surface is beautiful, and the saw seldom encounters breaking accident. However, the demerit of the saw is that it has a slow cutting speed.

(2) The segment type saw is constructed in such a way that an abrasive granule layer of segment type is firmly fixed by brazing, leaving spaces, at the outer circumference of a steel disc, so that the angular portions of each segment act as cutting edges to increase the cutting speed. However, this saw produces on the finishing surface a stripe-pattern based on the saw feeding, and moreover it has a demerit that the segment tends accidentally to break.

(3) As referred to above, the plate-form saw has the two types of gang saw and band saw. The fixing means of abrasive granule layer is similar as in said segment type saw, and therefore the advantages and disadvantages thereof are almost same as in (2) above.

The inventor of this invention has earnestly studied to make use of the merits of the conventional articles and eliminate the demerits thereof, and as the result he has succeeded in developing the present invention.

The object of the invention is to provide a diamond saw for cutting hard materials, in which a steel plate is firmly fixed with a sintered body consisting of diamond abrasive granules and bonding metal powder, said sintered body including diamond abrasive particles embeded in a matrix, characterized in that a plurality of grooves having openings are provided at the edges of both the front and back side faces of said sintered body, and said grooves are arranged in zigzag phase positions.

According to the invention, the cutting ability is improved compared with the conventional articles, the cutting speed is increased, the strength of the body including abrasive granule is improved, and therefore, the body including abrasive granule is prevented from a premature tearing-off and a breaking thereby to improve the safety when in use, the abrasive granules can be used in less amount, and further the saw life can be prolonged.

The invention will now be described more in detail with reference to the accompanying drawings, by way of embodiment examples, in which.

Figure 1:
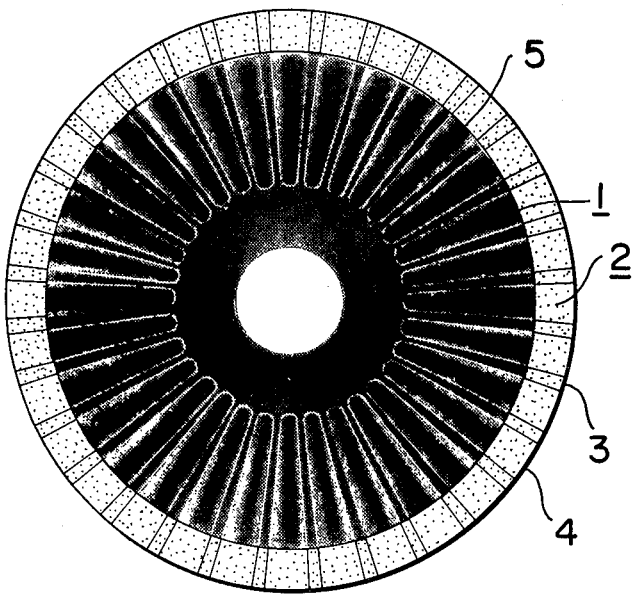
FIG. 1 is a plan view of a continuous type circular saw.
Figure 2:
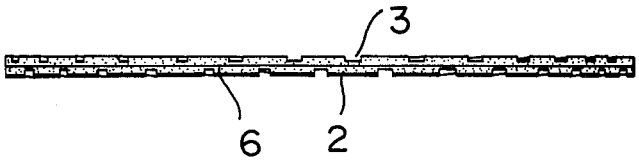
FIG. 2 is a side view of FIG. 1.

As referred to above, FIGS. 1 and 2 show examples of the continuous type circular saw. Reference numeral (1) designates a disc made of steel, and reference (2) is a sintered body including diamond abrasive particles embedded in a matrix. Said sintered body (2) consists of a mixture of diamond abrasive particles and a bonding metal powder. Reference (3) are a plurality of grooves provided at said sintered body, and these grooves (3) have openings, as shown in the drawings, at the edges of both the front and back side faces of the sintered body. The outer circumferencial flange of the circular steel plate (1) is provided with a thin portion (6), and the sintered body (2) is simultaneously sintered holding said thin portion (6) from both sides. As shown in FIG. 2, said grooves (3) are arranged in zigzag phase positions. The edges of said grooves are active as cutting blade thanks to the grooves in such an arrangement, and since a great number of grooves are provided the cutting ability is improved while the cutting speed increases. Further, the present saw has an excellent discharging of chips and an improved radiation efficiency so that it has an effect of causing no choking in the saw surface.

Figure 3:
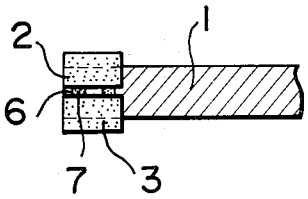
FIGS. 3 and 4 are partly sectional views each showing a fixing condition of the sintered body including diamond abrasive particles embedded in a matrix, to a steel plate.

As shown in FIG. 3, preferably said thin portion (6) is provided with a plurality of piercing orifices (7) which have optional shape and dimension, and in fixing the sintered body the sintered blades of both the front and back sides are simultaneously sintered in integrity thereby to be useful for increasing the strength.

Figure 4:
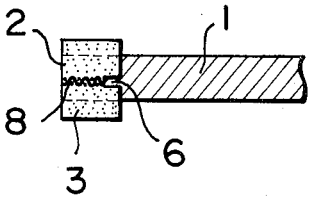

FIG. 4 shows a modification of the thin portion (6), a portion of which is replaced by a wire-netting (8) whereby the sintered body (2) is more integrated.

In FIG. 1, reference (5) designates a radial, corrugated portion provided in the circular steel plate (1), such provision of the corrugated portion enhances the strength of the circular steel plate, and therefore it becomes possible to lower the cost by using steel plate thiner than conventional articles. Furthermore, by constructing the saw in such a manner that the direction of said radial, corrugated shape is radial not including the center of the disc it is possible to further enhance the strength of said disc.

Figure 5:
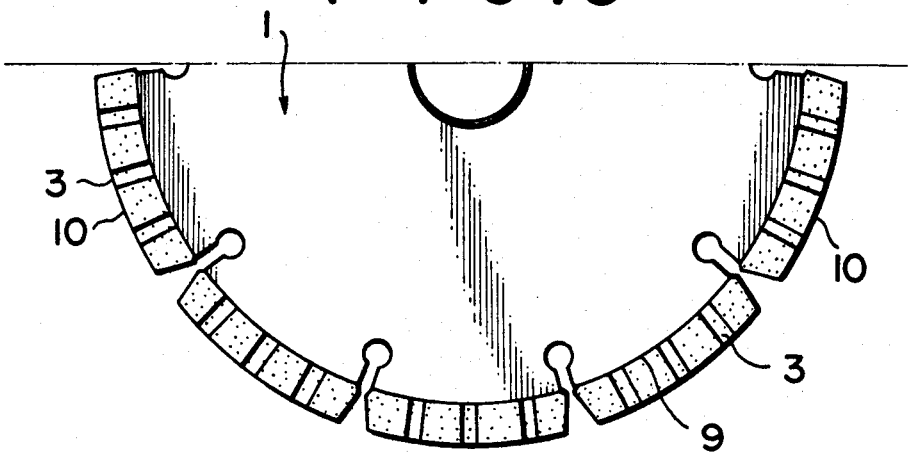
FIG. 5 is a plan view of a segment type circular saw.
Figure 6:
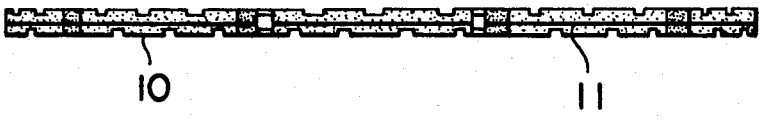
FIG. 6 is a side view of FIG. 5.

In case the diameter of circular saw is over 300 mm the saw can be a segment type circular saw as shown in FIGS. 5 and 6. In FIGS. 5 and 6, reference (10) is an arcuate segment, and one previously sintered as segment is used. The arranging positions of the grooves (3) are in zigzag phase in both the front and back sides as in the example of FIGS. 1 and 2. In this example, the outer circumferencial flange of the circular steel plate (1) is not provided with a thin portion, and the arcuate segment is directly fixed by brazing to the outer periphery (9) of said steel plate as in conventional articles, but it is preferable to arrange a reinforcing, perforated thin plate or a wire-netting (11) as shown in FIG. 6, at the center of the arcuate segment. The function and effect of said reinforcing, perforated thin plate or said wire-netting are same as the examples of FIGS. 3 and 4.

Figure 7:
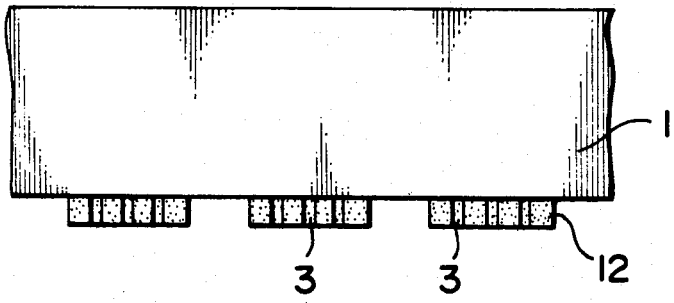
FIG. 7 is a plan view of a plate-form saw.
Figure 8:
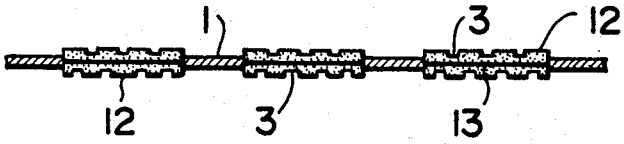
FIG. 8 is a side view of FIG. 7.

FIGS. 7 and 8 shows an example in which the present invention is applied to a plate-form saw, i.e. band saw or gang saw. In this case each segment (12) is rectilinear and the grooves (3) are arrenged in zigzag phase in both the front and back sides of the segment. This segment (12) is sintered in such a state that a reinforcing, perforated plate or a wire-netting (13) is held therewithin, and it is all right to secure the segment (12) to the base plate (1) by brazing means as in known articles.

Figure 9:
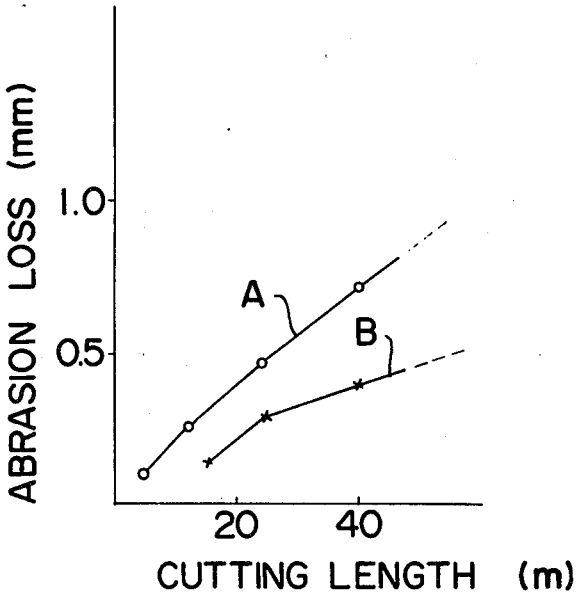
FIGS. 9 and 10 are graphs each comparing the abrasive loss and the power consumption between the present article and the conventional articles.
Figure 10:
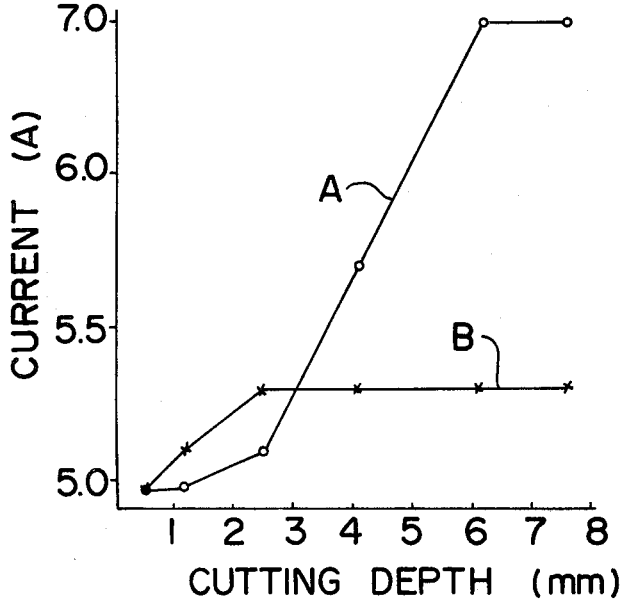

FIGS. 9 and 10 show graphs of comparison between the present saw and the conventional saws, and they show the results in which the present saw and the conventional saws are compared under the following conditions;

(1) Sample:
  A: Conventional segment type circular saw,
  B: Circular saw of the invention (of the type in FIGS. 1 and 2),
(2) Size: Both of 105 mm diameter and 2.0 mm thick blade,
(3) Material to be cut: Granite (produced in Inada, Japan),
(4) Infeed: 7 mm,
(5) Feed: 130 mm/min,
(6) Number of rotations: 12,000 RPM,
(7) Power supply: Disc grinder (Handy).

As is clear from FIG. 9, the abrasive loss of the present article B is less than about 60% of the conventional article A, while as clear from FIG. 10, even if the cutting depth is enlarged the present article does not increase the power consumption. That is, it will be evident the present article is superior in cutting ability over the conventional article.

Since the invention is constituted as described above it exhibits the following excellent effects, compared with the conventional saws:

(1) Circular saw:
  a. It has the merits in combination of both the continuous type and the segment type. That is, a great number of grooves are provided at both sides of the sintered body so that it possesses a cutting ability of the segment type and a strength of the continuous type.
  b. By arranging lots of grooves in zigzag phase at both side faces, chips are well discharged, radiation effeciency is improved, and choking by seizure does not occur, so that cutting ability and working efficiency are both improved.
  c. The outer periphery of the base plate is provided with a perforated, thin portion or a wire-netting, and the blade portion is simultaneously sintered, and therefore the strength is enhanced thereby preventing the blade portion from breaking. Accordingly, the safety is ensured very much while the saw life is prolonged.
(2) Plate-form saw:
  The side faces of each segment are provided with lots of grooves, and moreover, the saw is reinforced with a perforated, thin plate or a wire-netting, so that as a result of tests it has been confirmed that this saw has the same function and effect as in said circular saw.
(3) In any type of saw, by arranging a great number of grooves it will suffice to use a less amount of mixture consisting of diamond granules and binding metal which are used in the sintered body including diamond abrasive particles embedded in a matrix, and the present saw is economical in the cost point of view.

What is claimed is:

1. A diamond saw for cutting hard materials such as stone, rock or concrete, comprising:
  a support disc having an outer periphery and a pair of side faces, a plurality of corrugations being provided in each of said side faces; and,
  an abrading body which is secured to said outer periphery of said support disc, said abrading body including a mixture of diamond abrasive particles and a metal bonding powder, a pair of side faces being provided on said abrading body with each side face having a plurality of grooves, said abrading body grooves coinciding with and communicating with said corrugations of said support disc.

2. The diamond saw for cutting hard materials as described in claim 1, wherein the grooves provided at both the front and back side faces of said abrading body are positioned in zigzag phase.

3. The diamond saw for cutting hard materials as described in claim 1, wherein said support disc is a steel disc.

4. The diamond saw for cutting hard materials as described in claim 3 wherein said corrugations in said steel disc reinforce said disc thus enabling a thinner disc to provide the necessary resistance to outside forces during operation of the saw.

5. The diamond saw for cutting hard materials as described in claim 1, wherein said abrading body is simultaneously sintered from both sides onto said outer periphery of said support disc.

6. The diamond saw for cutting hard materials as described in claim 1, wherein a thin support portion is provided in said abrading body.

7. The diamond saw for cutting hard materials as described in claim 6, wherein said thin support portion is made of a wire-netting.

8. The diamond saw for cutting hard materials as described in claim 1, wherein the abrading body grooves are of the configuration of rectilinear lines having optional directions, and the grooves are arranged almost radially.

9. The diamond saw for cutting hard materials as described in claim 1, wherein said corrugations of said support disc are radially arranged and wherein said support disc is a circular steel plate.

10. The diamond saw for cutting hard materials as described in claim 1 wherein said abrading body is annular and encloses said outer periphery of said support disc.

11. The diamond saw for cutting hard materials as described in claim 1 wherein said support disc is provided with a plurality of circumferentially spaced indentations extending radially inwardly from said periphery of said disc wherein said indentations define a plurality of arcuate segments on said support disc, a separate arcuate abrading body being secured to each of said segments.

12. The diamond saw for cutting hard materials as described in claim 1 wherein each of said support disc corrugations gradually increases in width and depth as it extends from a center of said disc to said outer periphery.

13. The diamond saw for cutting hard materials as described in claim 1 wherein said support disc corrugations cooperate with said abrading body grooves to allow an efficient dispersal to cut particles and chips away from a cutting face of the saw.

* * * * *